US005556513A

United States Patent [19]

Shimazu et al.

[11] Patent Number: 5,556,513

[45] Date of Patent: Sep. 17, 1996

[54] MULTI-LAYER PAPER SHEET FORMING SYSTEM

[75] Inventors: Hiroto Shimazu; Takashi Bando, both of Mihara; Masateru Tokuno, Tokyo, all of Japan

[73] Assignees: Mitsubishi Jukogyo Kabushiki Kaisha; SK Engineering, Ltd., both of Tokyo, Japan

[21] Appl. No.: 273,136

[22] Filed: Jul. 14, 1994

[30] Foreign Application Priority Data

| | | | |
|---|---|---|---|
| Jul. 15, 1993 | [JP] | Japan | 5-196774 |
| Sep. 8, 1993 | [JP] | Japan | 5-223375 |
| May 25, 1994 | [JP] | Japan | 6-110672 |

[51] Int. Cl.[6] ..... D21F 11/04

[52] U.S. Cl. ..... 162/304; 162/303

[58] Field of Search ..... 162/133, 304, 162/273, 274, 303

[56] References Cited

U.S. PATENT DOCUMENTS

| | | | |
|---|---|---|---|
| 3,573,162 | 3/1971 | Brezinski | 162/303 |
| 3,772,140 | 11/1973 | Kobayashi | 162/304 |
| 4,004,968 | 1/1977 | Braun et al. | 162/304 |
| 4,154,645 | 5/1979 | Kankaanpaa | 162/304 |
| 4,830,709 | 5/1989 | Turner et al. | 162/304 |
| 5,445,713 | 8/1995 | Kunihisa et al. | 162/304 |

FOREIGN PATENT DOCUMENTS

| | | | |
|---|---|---|---|
| 340233 | 12/1977 | Australia . | |
| 0606524 | 7/1994 | European Pat. Off. . | |
| 2388936 | 11/1978 | France . | |
| 1808403 | 7/1969 | Germany . | |
| 1212830 | 11/1970 | United Kingdom . | |
| 2041030 | 9/1980 | United Kingdom | 162/304 |

*Primary Examiner*—Karen M. Hastings
*Attorney, Agent, or Firm*—Wenderoth, Lind & Ponack

[57] ABSTRACT

An improved multi-layer paper sheet forming system is disclosed, in which a degree of dispersion of fibers under the condition where a paper layer has been formed is large, thereby formation of a paper sheet is improved, moreover, bases of short wire cloth sections can be installed at the same level as a building floor and a complicated base of the shape of steps is not necessitated. The system comprises one endless felt loop and a plurality of short wire cloth sections disposed on the endless felt and provided with a dewatering instrument having, as dewatering elements, forming blades consisting of two zones, that is, a flat front half and a curved rear half. The short wire cloth section includes a forming roll having a large diameter and a breast roll having a small diameter, and the plurality of short wire cloth sections are disposed substantially at the same level. A movable return roll is equipped, which raises the felt between the adjacent short wire cloth sections so as to wrap around the short wire cloth so that an initial engagement point between the felt and the short wire cloth may come to an arbitrary position of the curved portion of the dewatering instrument existing at the upper portion of the short wire cloth section.

3 Claims, 13 Drawing Sheets

MULTI-LAYER PAPER SHEET FORMING SYSTEM

BACKGROUND OF THE INVENTION

1. Field of the Invention

The present invention relates to a multi-layer paper sheet forming system applicable to a paper making machine.

2. Description of the Prior Art

One example of a multi-layer paper sheet forming system in the prior art is illustrated in FIG. 9, which is a front view of a wet end of a short wire cloth duplex paper making machine. In FIG. 9, stock liquor ejected from a head-box 015 is formed into a paper layer by means of a conventional table instrument 016 (not shown in detail) disposed on a short wire cloth 017. This paper layer is engaged with an endless felt 018 on a forming cylinder 20, and while it is being dewatered by an urging pressure of the felt, it is combined with a paper layer formed in a preceding unit and having been carried by the felt. Under the state of being sandwiched between the felt and the short wire cloth, it is carried to a section of a turning roll 021, where bonding of both the above-described paper layers is effected by pressing with a turning touch roll 024. Thereafter, the wet paper layer is conveyed to the next unit loaded on the felt.

FIG. 10 shows another example of a multi-layer paper forming system in the prior art. The system of this example attempted to enlarge a dewatering capability by constructing a paper layer forming apparatus making use of two wire cloths in a short wire cloth section. Stock liquor ejected from a headbox 015' is dewatered by a conventional table instrument 016' (not shown in detail) disposed within a loop of the short wire cloth 025 and thereby a paper layer on the under side is formed.

Next, the paper layer is dewatered to the outside by wire tension of another short wire cloth 026 coming into engagement on a forming cylinder 020' and centrifugal force, and thereby an upper side portion of the paper layer is formed. Thereafter, the wet paper layer riding on the short wire cloth 025 is bonded with a paper layer formed in a short wire cloth section of the preceding stage and carried by a felt 018' by means of a couch roll 027 at the location where the same short wire cloth 025 is engaged with the felt 018'. The thus combined multi-layer paper sheet is either picked up by a suction pick-up roll 028 or transferred to the next stage (press part) by open-drawing.

FIG. 11 shows still another example of a multi-layer paper sheet forming system in the prior art. The system shown in FIG. 11 is a wet end of a general composite paper machine making use of a circular wire cylinder 022*a* shown in FIG. 12 or a suction cylinder 022*b* (circular wire wound) shown in FIG. 13, and it is shown in a front view. As shown in FIGS. 12 and 13, a headbox 021' is covered by a curved roof 021'*a* by a certain length along the circumference of the cylinder, stock liquor fed into a gap formed between this curved roof 021'*a* and the cylinder 022*a* or 022*b* is dewatered on the dewatering cylinder, and thereby a paper layer is formed. Then it is engaged with a wet paper sheet carried by a felt 032' on the cylinder 022a or 022*b* and they are combined together by a couch roll 326.

The thus combined multi-layer paper sheet is picked up by a suction pick-up roll 041' and transferred to the next stage (a press part). It is to be noted that reference numeral 026' in FIGS. 12 and 13 designates a couch roll.

In the above-described multi-layer paper sheet forming system in the prior art shown in FIG. 9, since formation of a paper layer is effected by the instruments called foils and table rolls, the dispersion power of the raw material fibers is weak, and so formation is poor. In addition, upon making a high grammage (basic weight) paper sheet at a high speed, since an endless felt is pressed on a cylinder having a small radius of curvature, the pressure becomes excessively high, and hence there was a shortcoming in that there occurred the so called crushing of the wet paper sheet, caused by poor dewatering of stock liquor on the forming cylinder 020.

In the case of the multi-layer paper sheet forming system shown in FIG. 10, although there was merit in that, because of a high air permeability of the wire wrapped around the forming cylinder 020', the dewatering pressure is mitigated, also the dewatering capability is increased, and hence the system can be better adapted to a high speed and a high grammage than the system shown in FIG. 9, there was also a shortcoming in that because of a high wet paper concentration before combination, the bonding strength was low. In addition, because of the fact that the short wire cloth unit is formed of two wire cloths, the unit length became long, the initial cost was also high, and a large installation area was necessary.

In the case of the multi-layer paper sheet forming system in the prior art shown in FIG. 11, since the dewatering was by a fixed pressure consisting of the pressure applied to the stock liquor sandwiched between the cylinder 022*a* or 022*b* and the curved roof 021'*a* of the headbox 021', pressure caused by the pressing force of the couch roll, and further a vacuum force applied to the cylinder 022*a* or 022*b*, there was a shortcoming in that a degree of dispersion of fibers under the state of forming a paper layer was low, and so the formation was poor. Furthermore, if an amount of deposition per unit is enlarged or the operation becomes high-speed, then a concentration of the wet paper coming into the combining section is lowered, and hence there occurs the problem of crushing of the wet paper by a nip pressure of the couch roll on the circular wire cloth cylinder 022*a* or the suction cylinder 022*b*. So it was impossible to choose a large amount of deposition per unit.

FIG. 14 shows yet another multi-layer paper sheet forming system proposed in Japanese Patent Application No. 5-20823 (1993) in order to overcome the shortcomings of the heretofore known multi-layer paper sheet forming system shown in FIGS. 9, 10 and 11. In this system, a plurality of short wire cloth sections 055, in which a dewatering instrument 054 is equipped within a loop of a short wire cloth 055', are disposed along a lower traveling path of an endless felt 056, and the endless felt 056 is made to travel on the dewatering instrument 054 jointly with the short wire cloth 055' so that in each short wire cloth section 055 stock liquor may be ejected from a headbox 053 into the space between the endless felt 056 and the short wire cloth 055'.

However, in this system, since a part of the headbox 053 projects above a breast roll 057, it is necessary to make the endless felt 056 travel so as to avoid it, and accordingly there was a problem that since the arrangement of the plurality of short wire cloth sections 055 formed a step-like shape, if the number of the short wire cloth sections became large, the base would become complicated and expensive. It is to be noted that in FIG. 14, reference numeral 054*a* designates a shoe blade, numeral 058 designates a turning roll, numeral 059 designates a stretch roll, numeral 060 designates a guide roll, numeral 061 designates a lead-in roll, numeral 062 designates a couch roll, numeral 063 designates a suction couch roll, numeral 064 designates a felt roll, numeral 065 designates a flow-back device, and numeral 066 designates a suction pick-up roll.

SUMMARY OF THE INVENTION

It is therefore one object of the present invention to provide a multi-layer paper sheet forming system in which the above-mentioned shortcomings of the multi-layer paper sheet forming systems in the prior art can be obviated and nevertheless all the plurality of short wire cloth sections can be installed substantially at the same level.

According to one feature of the present invention, there is provided a multi-layer paper sheet forming system including one endless felt loop and a plurality of short wire cloth sections each having an endless short wire cloth and a dewatering instrument whose upper surface has a curvature. The felt is engaged with stock liquor at a curved portion of the dewatering instrument, and thereafter, while the felt is traveling with stock liquor sandwiched between the short wire cloth and the felt, combined formation of paper layers is effected. The plurality of short wire cloth sections are installed substantially at the same level, and each of the aforementioned short wire cloth sections is constructed in such a manner that the short wire cloth may travel engaged with the curved portion of the dewatering instrument. A forming roll has a large diameter and a breast roll has a small diameter.

According to another feature of the present invention, there is provided a multi-layer paper sheet forming system including one endless felt loop and a plurality of short wire cloth sections each having a rotating dewatering cylinder disposed under the felt loop for effecting initial dewatering. A dewatering instrument is disposed downstream of the same cylinder and is arranged in such a manner that upper surfaces of a plurality of dewatering elements thereof have a curvature. The endless felt is engaged with the short wire cloth on a curved portion of each dewatering instrument. While the felt is traveling with stock liquor ejected from a headbox positioned under the top of the above-mentioned dewatering cylinder sandwiched between the above-mentioned endless felt and the short wire cloth, paper layers are formed and combined as dispersion and dewatering by a pulsed pressure are effected. Further the above-mentioned dewatering cylinder in the short wire cloth section is formed as a suction cylinder and the aforementioned dewatering instrument in the short wire cloth section has a structure capable of dewatering by vacuum.

According to still another feature of the present invention, there is provided a multi-layer paper sheet forming system including one endless felt loop and a plurality of short wire cloth sections disposed thereon and each having an endless short wire cloth and a dewatering instrument disposed in such manner that a part of an upper surface of a dewatering element thereof may have a curvature. A movable return roll is disposed so that it may raise the felt between the respective short wire cloth sections so as to wrap around the short wire cloth. An initial engagement point between the felt and the short wire cloth may be at an arbitrary position of the aforementioned curved portion of the dewatering instrument disposed above the short wire cloth section. The system comprises a shoe blade positioned above the above-mentioned dewatering instrument and within the felt loop, disposed so as to oppose to the above-mentioned dewatering element and supported in such manner that its urging pressure against the felt may be variable. The surface consists of a portion coming into contact with the felt and a portion inclined towards the felt so that a wedge-shaped space converging along the traveling direction of the felt may be formed between the inclined portion and the felt. Further the above-mentioned dewatering instrument for the short wire cloth has a structure capable of promoting dewatering by means of vacuum.

According to the present invention as first featured above, stock liquor ejected onto a short wire cloth is dewatered during the period when it is traveling sandwiched between an endless felt and a short wire cloth, and while a paper layer is being formed it is combined with another paper layer. In addition, since the respective short wire cloth sections are installed substantially at the same level, a base having a step-like shape becomes unnecessary. Furthermore, owing to a dewatering instrument having a large radius of curvature, a gradually increasing urging pressure of the felt is generated, and so the stock liquor can be dewatered moderately.

Also according to the present invention as secondarily featured above, although stock liquor ejected from a headbox onto a dewatering paper machine is subjected to initial dewatering on a rotating dewatering cylinder, since it is sandwiched between a felt and a wire cloth on the portion of a dewatering device having a downstream curvature during the period when fibers in a mat still have mobility, it is dispersed by the action of a pulsed pressure generated when it passes a dewatering element in the succeeding stage, and thereby good formation can be realized. In addition, since this curvature corresponds to a far larger radius of curvature than the dewatering cylinder in the prior art, the urging pressure of the felt is small and dewatering can be effected moderately. Furthermore, since the dewatering instrument can be subjected to vacuum, the dewatering capability becomes large. Accordingly, the wet paper concentration at the time of being couched is high, and so, in a wet paper sheet, crushing would not occur. In this short wire cloth section, since stock liquor can be carried into an engagement section between a felt and a short wire cloth after the stock liquor has been loaded on a dewatering cylinder, there is no need to dispose a headbox above the top of a dewatering cylinder, a plurality of short wire cloth sections can be disposed at the same level, and accordingly a base having step-like shape would not be necessary.

In addition, according to the present invention as thirdly featured above, owing to the fact that the respective short wire cloth sections are disposed above an endless felt, headboxes and short wire cloth sections are not subjected to any limitation with respect to their positions in the vertical direction, and it is also easy to install the respective short wire cloth sections at the same level with respect to a building floor. Also with regard to the problems of improvements in the ease of dewatering of stock liquor and formation, the dewatering capability is increased and the interlayer strength is improved. The dewatering instrument including dewatering elements each having a curvature in part is disposed in an upper portion within a short wire cloth section and an endless felt is engaged onto the dewatering instrument. Also, an initial engagement point between the felt and the short wire cloth can be brought to any arbitrary position of the curved portion of the dewatering instrument by making use of a movable return roll.

Accordingly, even if the thickness of stock liquor being fed should change, the stock liquor can be moderately dewatered by the gradually varying urging pressure of the felt, and simultaneously with an improvement in formation by the action of the pulsed pressure generated by the dewatering elements, the formation of paper layers is effected. In addition, since a paper layer is formed from stock liquor ejected from a headbox, and a wet paper sheet formed by combining the paper layer with another paper layer formed in the preceding stage by means of a couch roll, is carried to a breast part in the next stage as loaded on the endless felt, the problem of the so-called "sheet drop off" would not arise.

BRIEF DESCRIPTION OF THE DRAWINGS

The above-mentioned and other objects, features and advantages of the present invention will become more apparent by reference to the following description of a number of preferred embodiments of the present invention taken in conjunction with the accompanying drawings.

In the accompanying drawings.

DESCRIPTION OF THE PREFERRED EMBODIMENTS

Figure 1:
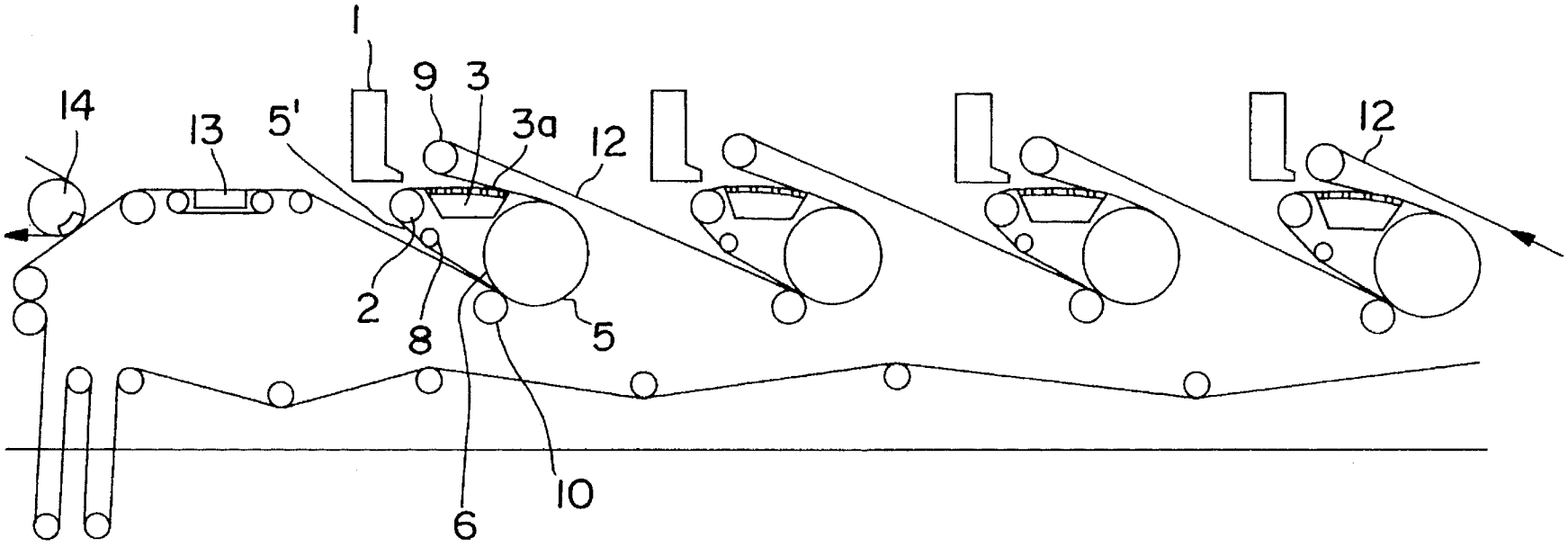
FIG. 1 is a cross-section front view of a paper machine wet end equipped with a multi-layer paper sheet forming system according to a first preferred embodiment of the present invention.
Figure 2:
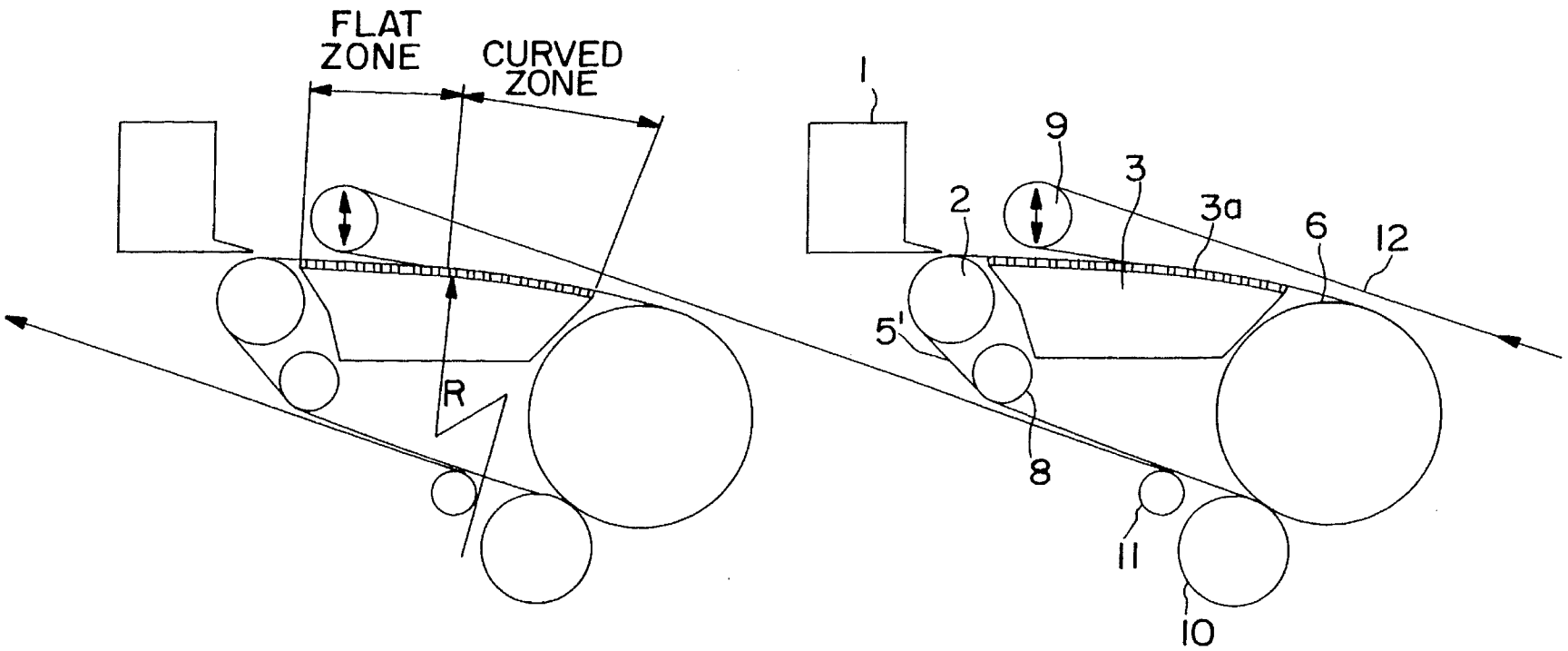
FIG. 2 is a detailed cross-section view of an essential part of the system shown in FIG. 1.

In the following, the present invention will be described in greater detail in connection to the preferred embodiments illustrated in the accompanying drawings. FIGS. 1 and 2 illustrate a first preferred embodiment of the present invention, in which reference numeral 1 designates a headbox, numeral 2 designates a breast roll having a small diameter, numeral 3 designates a dewatering instrument, numeral 5 designates a short wire cloth section, numeral 5' designates a short wire cloth, numeral 6 designates a forming roll having a large diameter, numeral 8 designates a guide roll, numeral 9 designates a return roll, numeral 10 designates a couch roll, numeral 11 designates a suction box, numeral 12 designates an endless felt, numeral 13 designates a flow-back device, and numeral 14 designates a suction pick-up roll. The above-mentioned short wire cloth section 5 comprises an endless short wire cloth 5' and a dewatering instrument 3, and a plurality of short wire cloth sections 5 are disposed substantially at the same level (height). The above-described dewatering instrument 3 has a plurality of forming shoe blades **3*a* and the same dewatering instrument 3 form two zones consisting of a flat zone in a front half and a curved zone in a rear half which is upwardly convex. The endless felt 12 is engaged with the dewatering instrument 3 by means of the return roll 9 so as to cover the dewatering instrument 3, and by positional adjustment of the return roll 9, the felt 12 can be initially engaged with the dewatering instrument 3** at any arbitrary position of the curved zone.

In addition, the dewatering instrument 3 has a far larger radius of curvature than a forming roll in the prior art. Dewatering pressure can be changed by blade exchange, and it is also possible to make the dewatering instrument 3 subjected to a vacuum.

On the other hand, the above-described forming shoe blades **3*a* consist of a plurality of blades, and they serve to improve formation by redispersing fibers in the stock liquor with shearing forces induced by a pulsed pressure occurring at the locations of the respective blades 3*a*. It is to be noted that the dewatering elements are not limited to the shoe blades 3*a***, but could be rolls having a small diameter, and it is obvious that the feature of the present invention is not lost even if they are alternately arranged.

In this first preferred embodiment, since the plurality of short wire cloth sections 5 are disposed substantially at the same level, a base having a step-like shape is not necessary.

The position where the stock liquor ejected from the headbox 1 is sandwiched between the short wire cloth 5' and the endless felt 12 can be set at an optimum position so as to smoothly dewater the stock liquor depending upon a thickness of the incoming stock liquor by adjusting the return roll 9 provided within the loop of the endless felt 12 in the upward or downward direction as indicated by arrows in FIG. 2. Moreover, since a radius of curvature of the dewatering portion is large, urging pressure by the felt is low, the portion has an easy structure for dewatering, and further, since dewatering by vacuum is also possible, smooth dewatering can be effected.

Thereafter, since a pulsed pressure acts upon the stock liquor sandwiched between the felt 12 and the short wire cloth 5', dispersion and dewatering are promoted, and simultaneously a combination with a paper layer formed in the preceding stage is effected. Accordingly, since the paper layer formed in the short wire cloth section 5 has a sufficiently raised concentration, even if an urging pressure of the felt becomes high on the forming roll 6, the so-called crushing would not occur. Rather, the paper layer is bonded to the paper layer formed in the preceding stage by the couch roll 10, and thereafter the paper layers are perfectly transferred from the short wire cloth section 5 to the side of the endless felt 12. Since they are carried to the next stage loaded on the felt 12, a possibility of the so-called "sheet drop off" does not exist at all.

Figure 3:
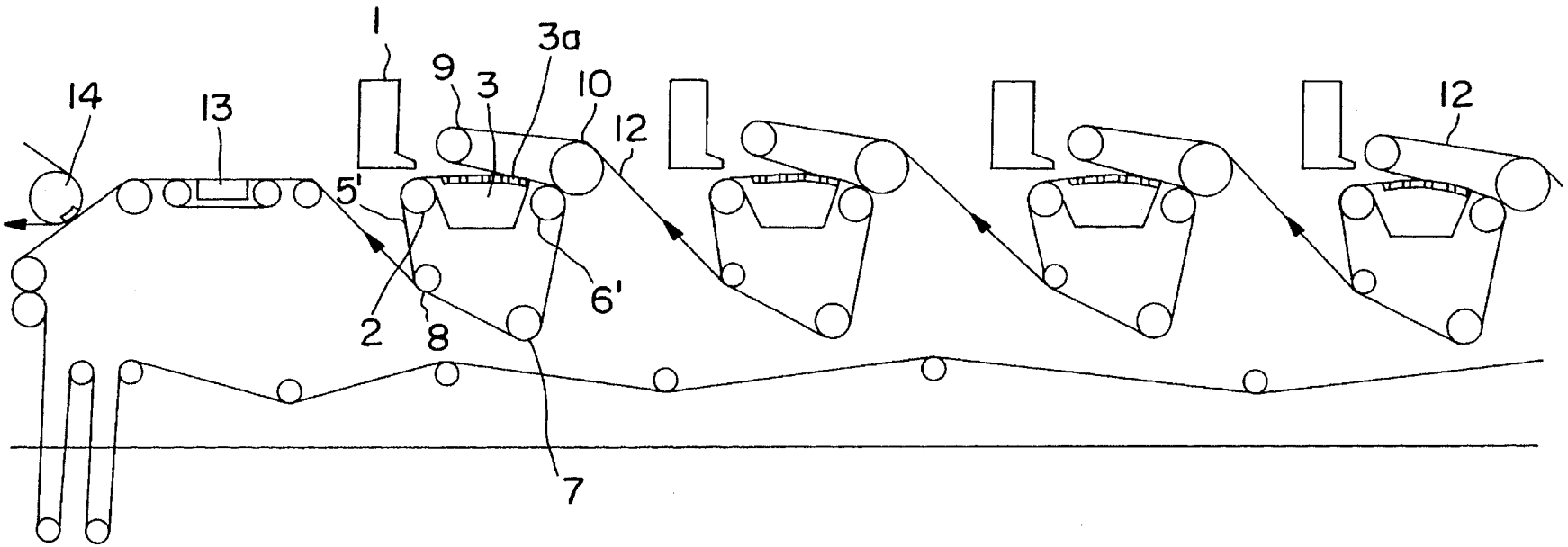
FIG. 3 is a cross-section front view of a paper machine wet end showing a second preferred embodiment of the present invention.

Next, a second preferred embodiment of the present invention will be described with reference to FIGS. 3 and 4. A short wire cloth unit in FIGS. 3 and 4 includes an endless short wire cloth 5' and a dewatering instrument 3 having a plurality of forming shoe blades 3*a*, and this dewatering instrument 3 is formed of two zones consisting of a flat front half and a curved rear half. An endless felt 12 is engaged with the dewatering instrument 3 by means of a return roll 9 so as to cover the same dewatering instrument 3, and by positional adjustment of the return roll 9, the felt can be initially engaged with the dewatering instrument 3 at any arbitrary position of the curved zone. In addition, the dewatering instrument 3 has a far larger radius of curvature than a forming roll in the prior art, dewatering pressure can be changed by blade exchange, and it is also possible to make the dewatering instrument 3 subject to a vacuum. Furthermore, the couch roll 10 is adapted to press a paper layer sandwiched between the felt 12 and the short wire cloth 5' on a turning roll 6', simultaneously with guiding the endless felt 12 to the return roll 9.

Also, the forming shoe blades 3*a* consist of a plurality of blades, and they serve to improve formation by redispersing fibers in the stock liquor with shearing forces induced by a pulsed pressure occurring at the location of the respective blades 3*a*. It is to be noted that the dewatering elements are not limited to the shoe blades 3*a*, but could be rolls having a small diameter, and it is obvious that the feature of the present invention is not lost even if they are alternately arranged.

Figure 4:
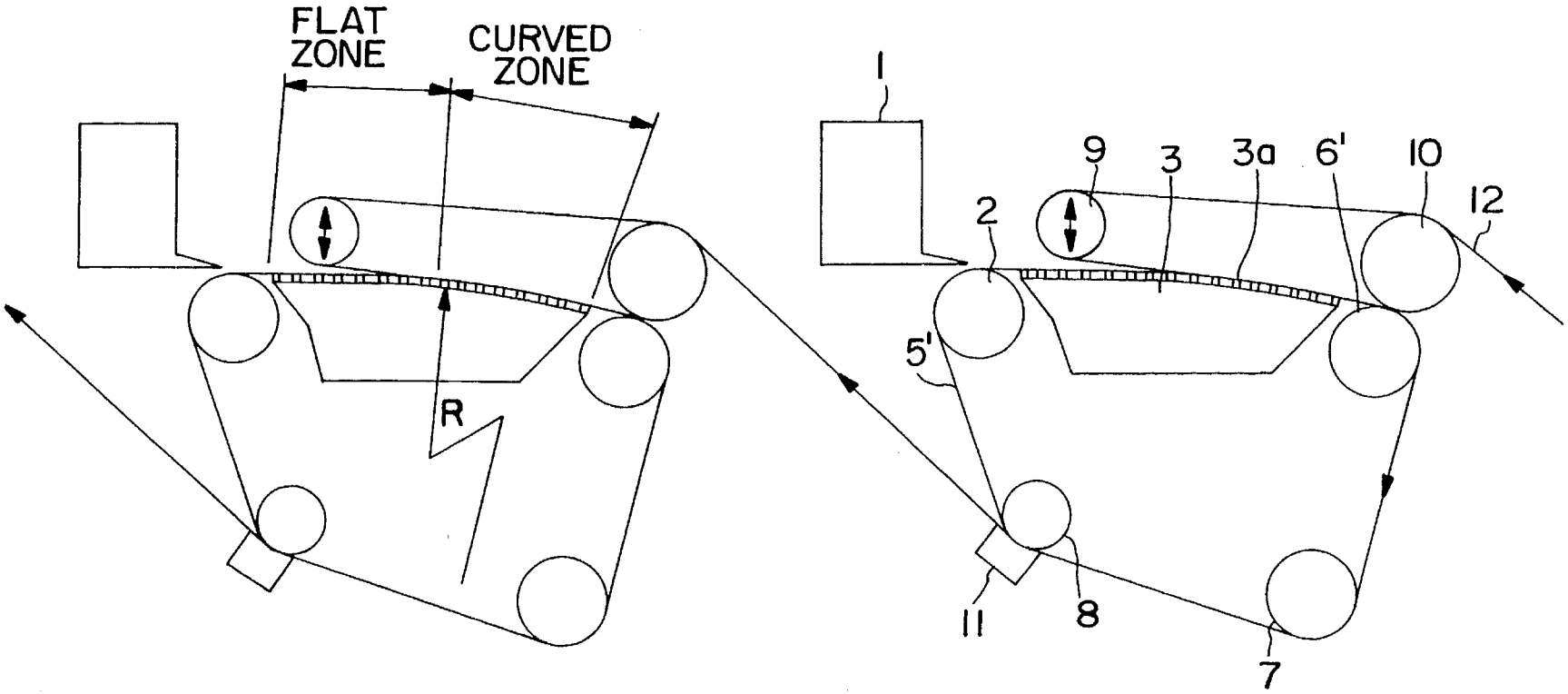
FIG. 4 is a detailed cross-section view of an essential part of the system shown in FIG. 3.

In this preferred embodiment, the position where the stock liquor ejected from the headbox 1 is sandwiched between the short wire cloth 5' and the endless felt 12 can be set at an optimum position so as to smoothly dewater the stock liquor depending upon a thickness of the incoming stock liquor by adjusting the return roll 9 provided within the loop of the endless felt 12 in the upward or downward direction as indicated by arrows in FIG. 4. Moreover, since the radius of curvature of the dewatering portion is large, an urging pressure by the felt is low, the portion has a structure for easy dewatering, and further, since dewatering by vacuum is also possible, smooth dewatering can be effected.

Thereafter, since a pulsed pressure acts upon the stock liquor sandwiched between the felt 12 and the short wire cloth 5', dispersion and dewatering are promoted, and simultaneously a combination with a paper layer formed in the preceding stage is effected. Accordingly, since the paper layer formed in the short wire cloth section 5 has a sufficiently raised concentration, even if it is pressed by the couch roll 10 on the turning roll 6', the so-called crushing would not occur. Rather, the paper layer is bonded to the paper layer formed in the preceding stage, and while they are kept sandwiched between the endless felt 12 and the short wire cloth 5' they are carried to a stretch roll 7 and a guide roll 8. Then the paper layers are perfectly transferred from the short wire cloth section 5 to the side of the endless felt 12 by means of a suction box 11. Since they are carried to the next stage loaded on the felt, a possibility of the so-called "sheet drop off" phenomenon does not exist at all.

Figure 5:
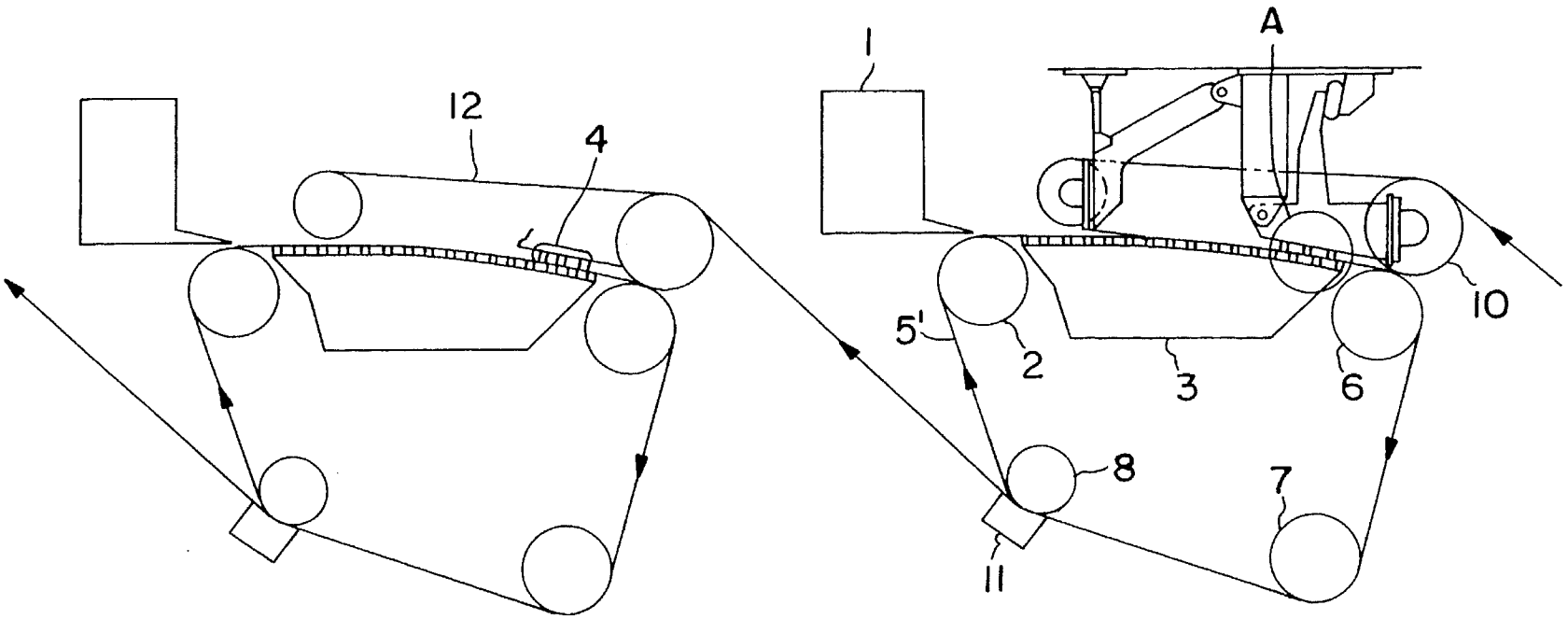
FIG. 5 is a detailed cross-section view showing an essential part of a third preferred embodiment of the present invention.
Figure 6:
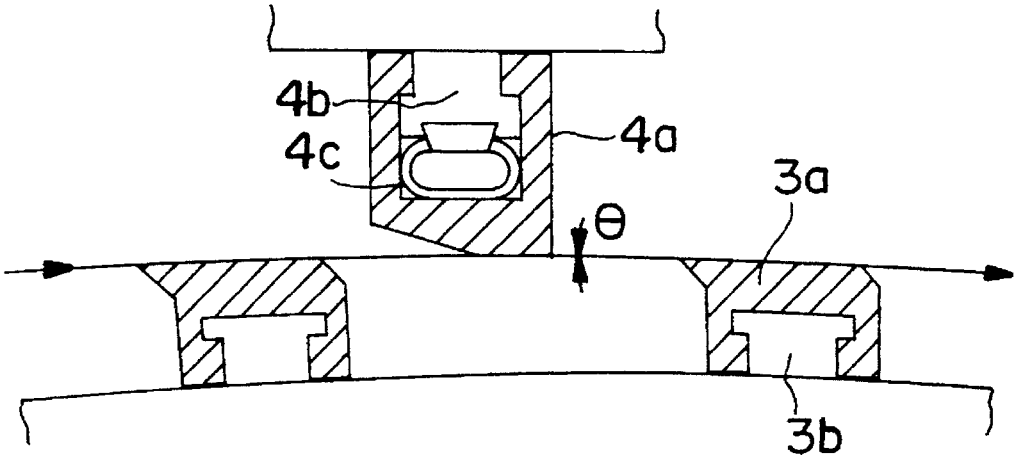
FIG. 6 is an enlarged partial cross-section view showing a detailed structure of a part encircled at A in FIG. 5.

A third preferred embodiment of the present invention is illustrated in FIGS. 5 and 6. This preferred embodiment intends to further increase a dispersing property at the portion of the dewatering instrument 3 and thereby achieves improvements in formation, in addition to the advantages of the second preferred embodiment shown in FIGS. 3 and 4.

More particularly, in this third preferred embodiment, in addition to the construction shown in FIG. 4, shoe blades 4*a*, located between adjacent shoe blades 3*a* of the dewatering instrument 3 and opposed to the dewatering instrument 3, are supported within the loop of the endless felt 12 by means of flexible tubes 4*c* so that their positions may be variable. The magnitude of the pulsed pressure which determines a dispersion property of stock liquor in a fixed dewatering instrument having shoe blades would become larger as a flexing angle (θ) of the wire cloth and felt sandwiching stock liquor therebetween at an inlet of the shoe blade becomes larger.

Accordingly, if the shoe blades 3*a* and 4*a* are opposed to each other, and the configuration of the shoe blade 4*a* is formed so as to consist of a portion coming into contact with the felt and another portion inclined so that a wedge-shaped space converging along the traveling direction of the felt is formed on the inlet side between the felt and the shoe blade then the water in the felt squeezed out into the wedge-shaped space formed in front of the shoe blade 4*a* by pressing the shoe blade 4*a* would pass through the space between the shoe blade 4*a* and the felt and would depress the assembly of (felt+wet paper sheet+wire cloth).

At that moment, a flexing angle (θ) at the front end of the downstream shoe blade 3*a* is increased, and so, the pulsed pressure increases. Since this pressure has an optimum value depending upon a grammage (basic weight) and a paper making velocity of each unit, the position of the shoe blade 4*a* is made variable by adjusting the pressure in the tube 4*c* for supporting the shoe blade 4*a*, and thus flexibility is increased.

Now, a fourth preferred embodiment of the present invention will be described with reference to FIGS. 7 and 8, in which reference numeral 21 designates a headbox associated with a curved roof 21*a*, numeral 22 designates a dewatering cylinder, numeral 23 designates a dewatering instrument, numeral 23*a* designates a dewatering element of the dewatering instrument 23, numeral 24 designates a short wire cloth section having a short wire cloth 24', numeral 25 designates a turning roll for the short wire cloth 24', numeral 26 designates a couch roll, numeral 27 designates a stretch roll (associated with a short wire cloth guide) for the short wire cloth 24', numeral 28 designates a lead-in roll, numeral 29 designates a suction couch roll, numeral 30 designates a flow-back device, numeral 31 designates a suction pick-up roll, and numeral 32 designates an endless felt.

Figure 7:
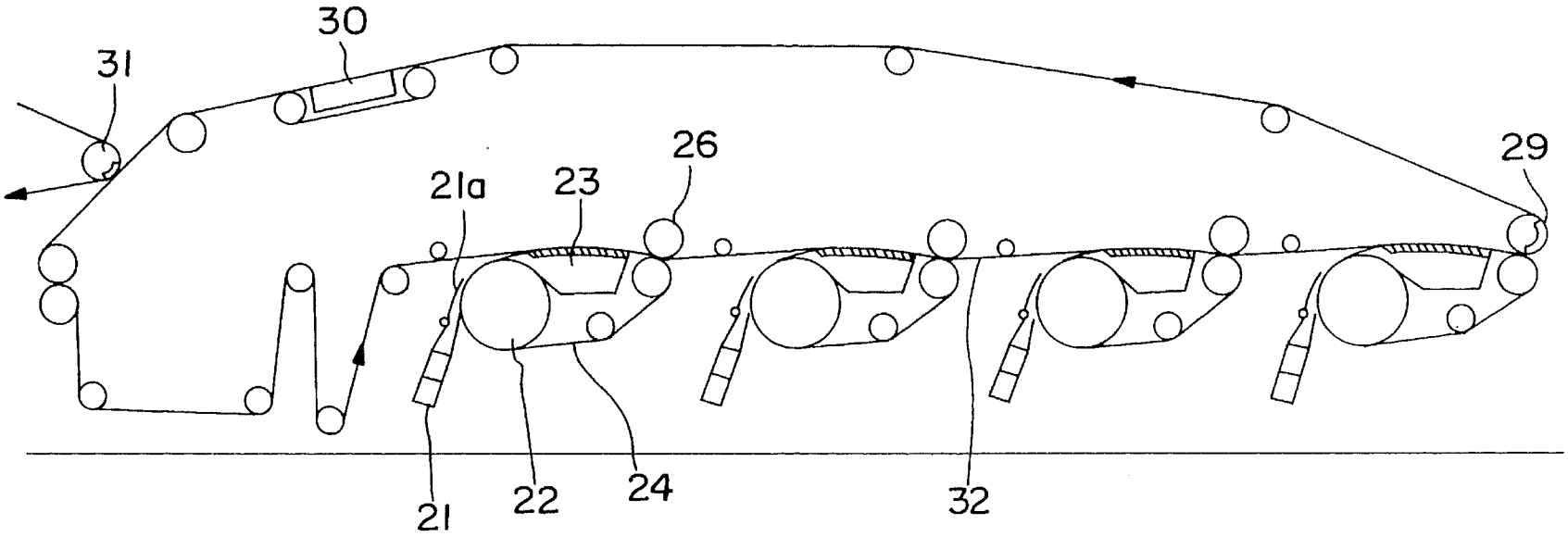
FIG. 7 is a cross-section front view of a paper machine wet end equipped with a multi-layer paper sheet forming system according to a fourth preferred embodiment of the present invention.
Figure 8:
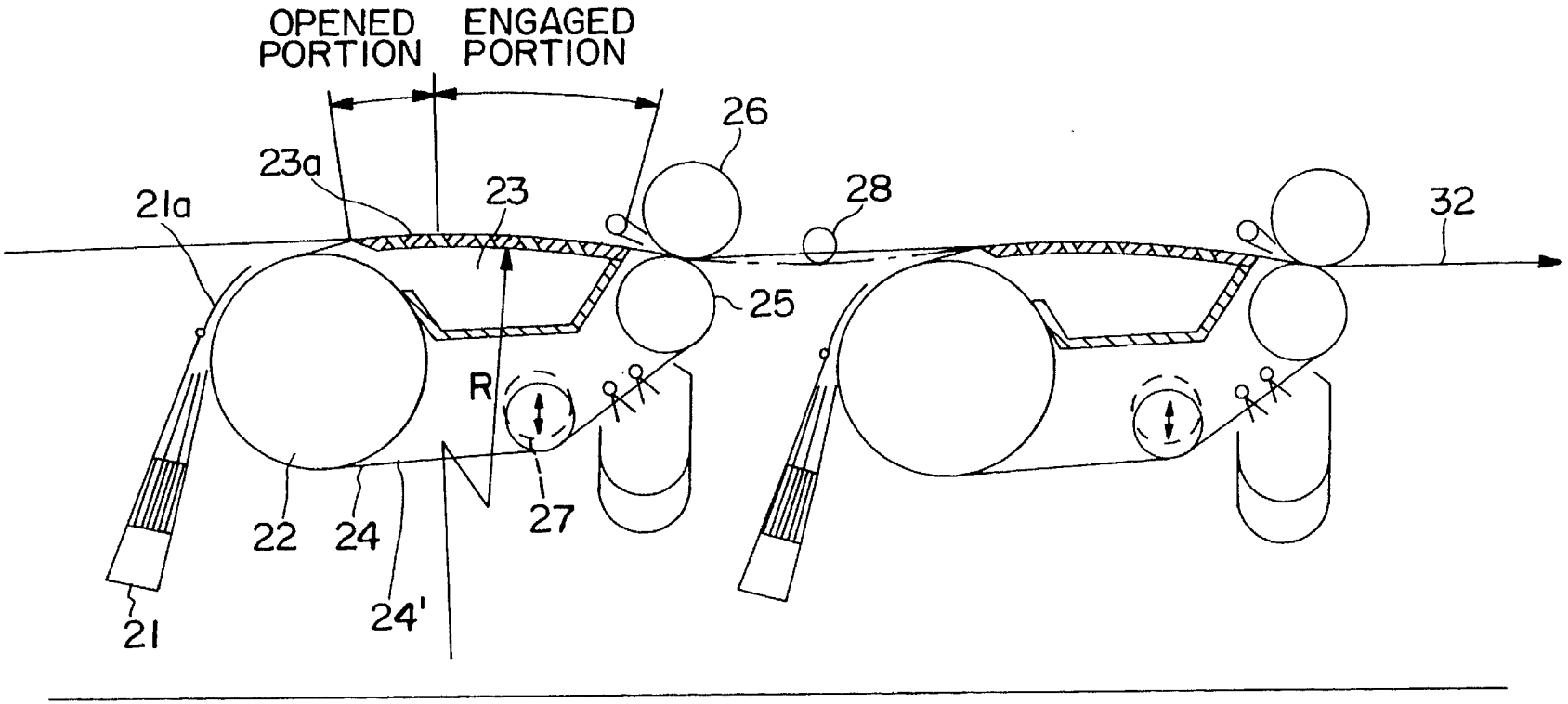
FIG. 8 is a detailed cross-section view of an essential part of the system shown in FIG. 7.
Figure 9:
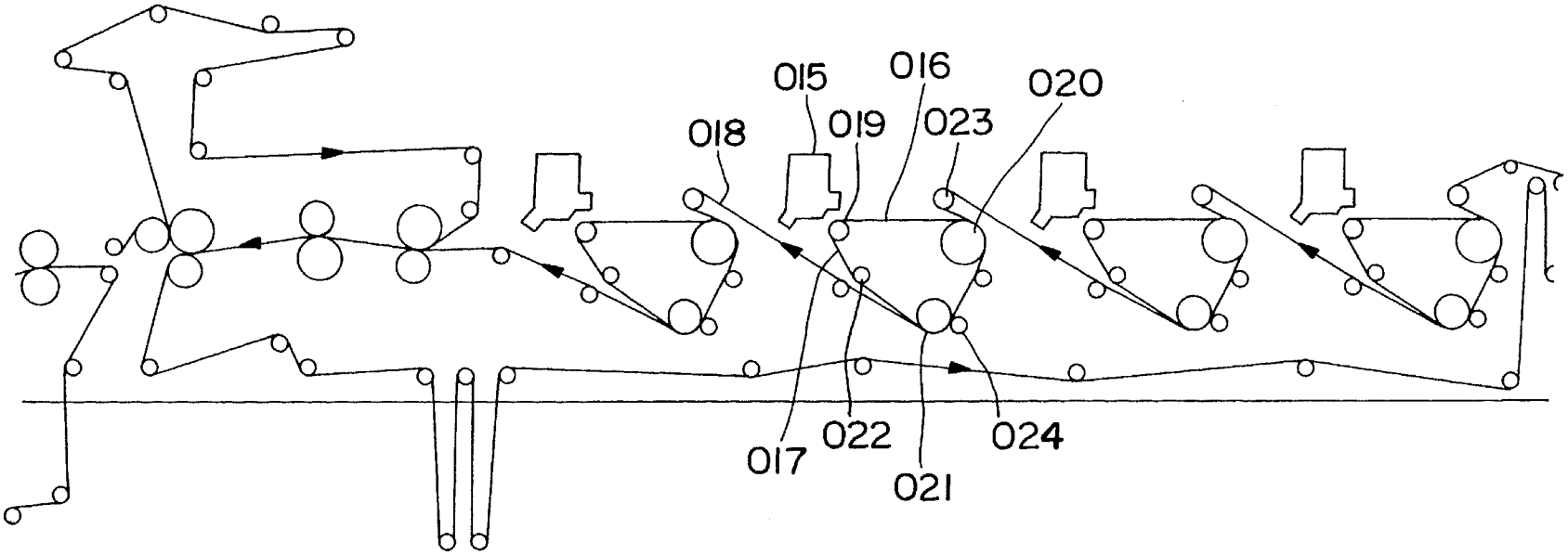
FIG. 9 PRIOR ART
FIG. 9 is a cross-section front view of a paper machine wet end equipped with one example of a multi-layer paper sheet forming system in the prior art.
Figure 10:
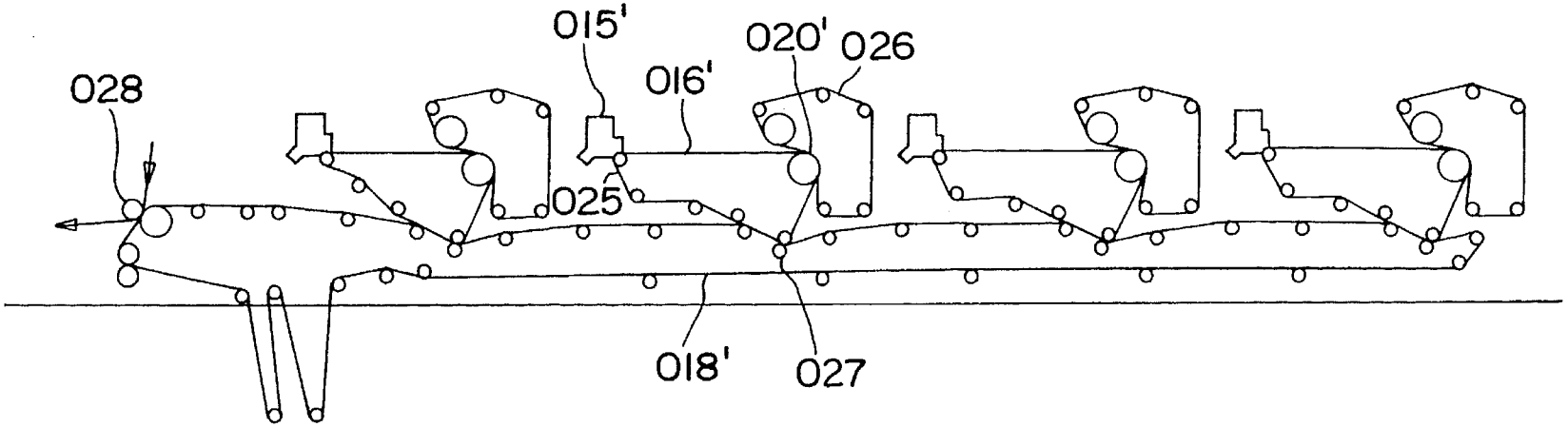
FIG. 10 PRIOR ART
FIG. 10 is a cross-section front view of a paper machine wet end equipped with another example of a multi-layer paper sheet forming system in the prior art.
Figure 11:
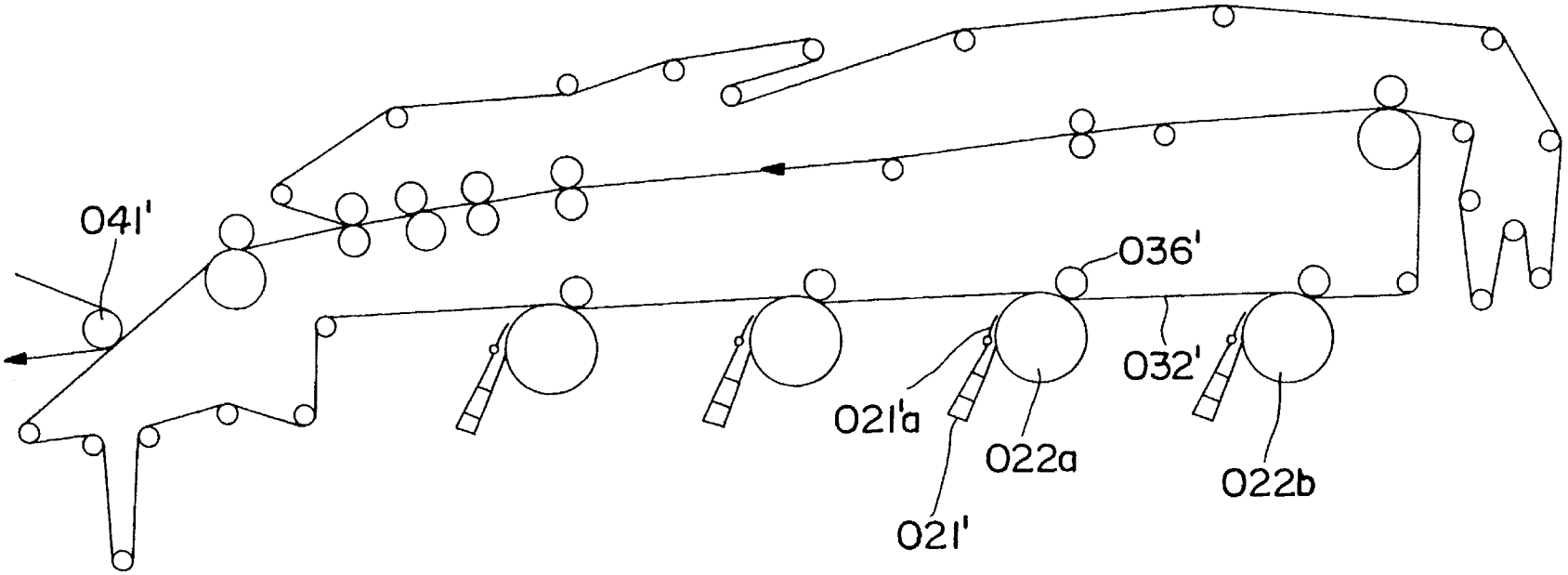
FIG. 11 PRIOR ART
FIG. 11 is a cross-section front view of a paper machine wet end equipped with still another example of a multi-layer paper sheet forming system in the prior art.
Figure 12:
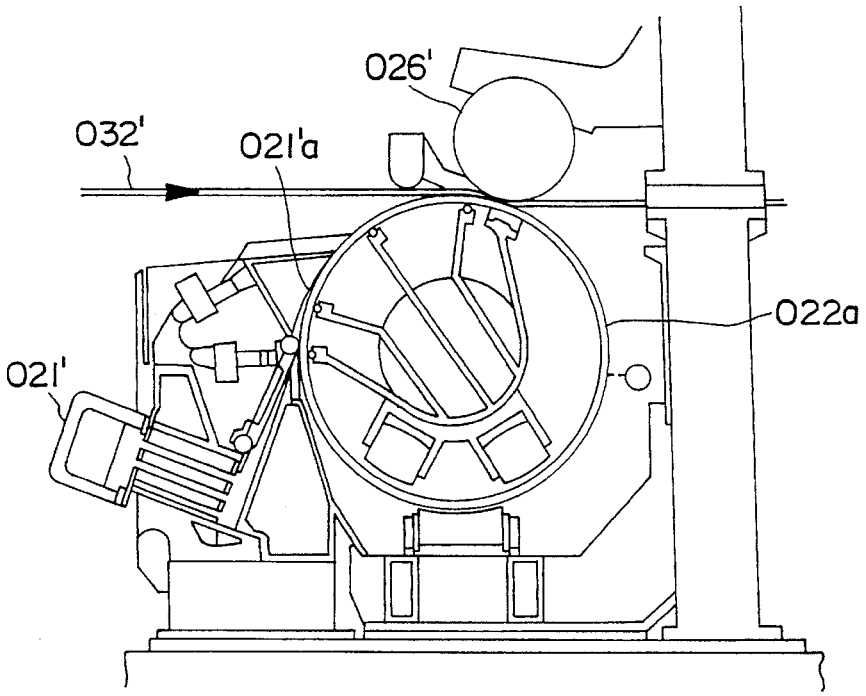
FIG. 12 PRIOR ART
FIG. 12 is a detailed cross-section view of one example of a dewatering cylinder section in FIG. 11.
Figure 13:
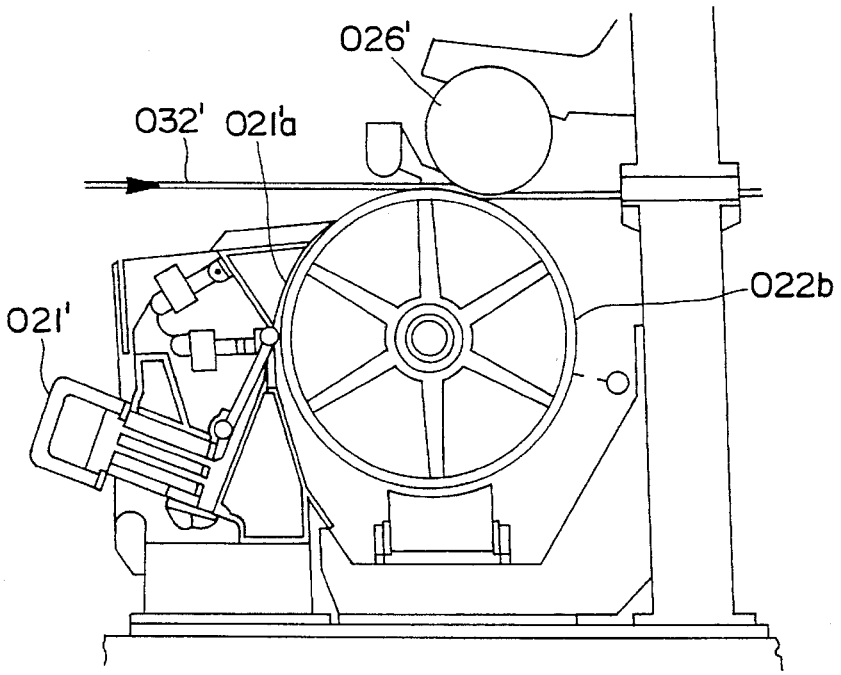
FIG. 13 PRIOR ART
FIG. 13 is a detailed cross-section view of another example of a dewatering cylinder section in FIG. 11.
Figure 14:
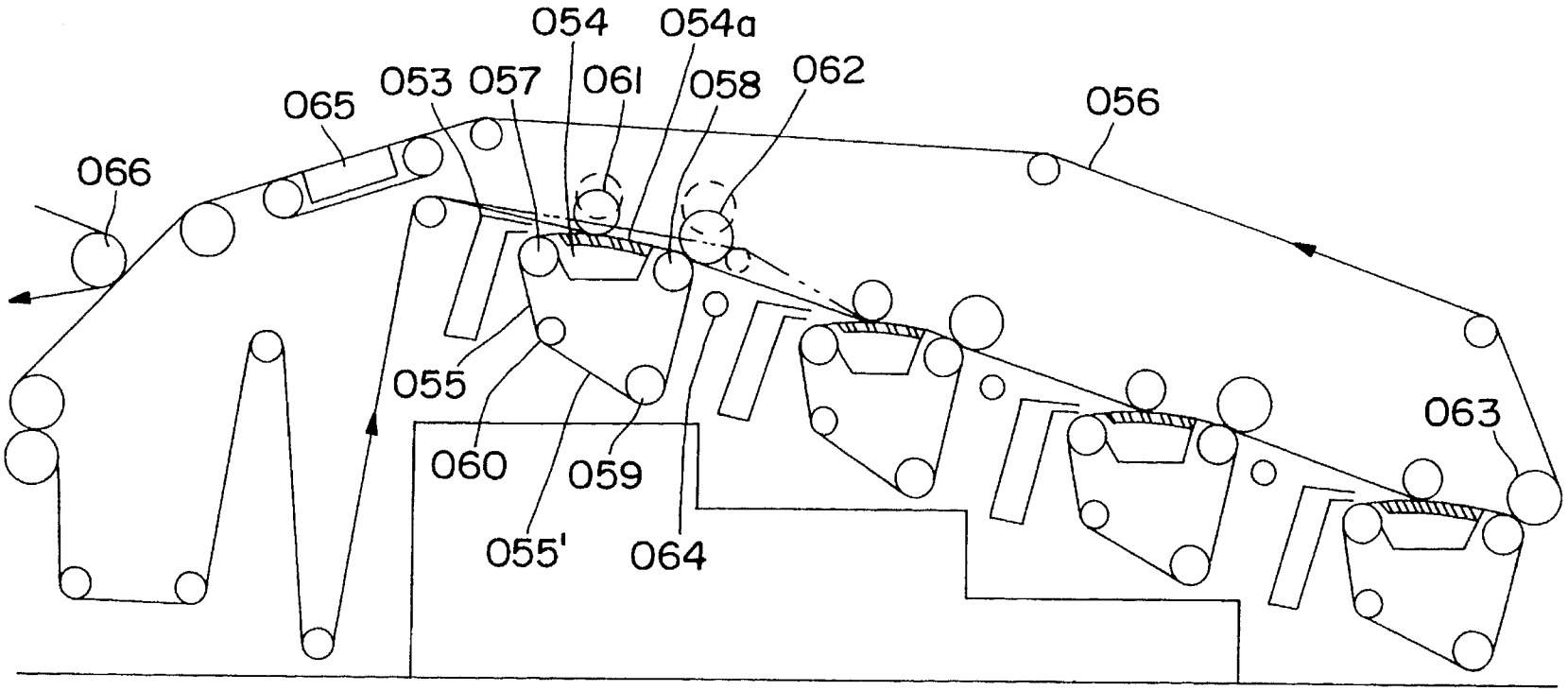
FIG. 14 PRIOR ART
FIG. 14 is a cross-section front view of a paper machine wet end equipped with a multi-layer paper sheet forming system in the prior art, which was proposed in order to eliminate the shortcomings of the heretofore known multi-layer paper sheet forming systems illustrated in FIGS. 9 to 13.

The short wire cloth section 24 comprises an endless short wire cloth 24' and a dewatering instrument in its upper portion, and as shown in FIG. 7, a plurality of short wire cloth sections 24 are disposed substantially at the same level. The above-mentioned dewatering instrument 23 has its upper surface curved in an upwardly convex shape, and is provided with a plurality of dewatering elements 23*a*. It is to be noted that as the dewatering elements 23*a*, shoe blades or the like are employed.

In this fourth preferred embodiment, stock liquor fed from the headbox 21 into the space between the curved roof 21*a* and the dewatering cylinder is initially dewatered into the dewatering cylinder 22 by a pressure determined in dependence upon the feeding pressure and the gap dimension. Thereafter, it enters a combining section where the dewatering instrument 23 and the endless felt 32 are engaged with each other as loaded on the short wire cloth 24'.

In the dewatering section for the stock liquor, since the radius of curvature of the arrangement of the dewatering elements 23*a* is far larger than a cylinder in the prior art, the urging pressure of the felt is small and the stock liquor can be moderately dewatered. Thereafter, owing to a pulsed pressure generated by the dewatering elements 23*a*, fibers in the stock liquor are dispersed, it is simultaneously dewatered toward the side of the dewatering instrument 23, and thereby the formation of a paper layer and a combination of paper layers are effected.

In addition, it is also possible to increase the dewatering capability by making the dewatering instrument 23 subject to a vacuum. It is to be noted that the dewatering elements could be either shoe blades 23*a* as shown in FIG. 8 or small rolls (not shown). Subsequently, after the paper layers have been further bonded by a pressing force of the couch roll 26 opposed to the turning roll 25, they are picked up to the side of the endless felt 32 and carried to the next unit.

Furthermore, in the illustrated fourth preferred embodiment, since the headbox 21 is positioned lower than the top of the dewatering cylinder 22, even if a felt run entering the short wire cloth section is inclined downward from the horizontal direction, it would not interfere with the above-mentioned headbox 21. Accordingly, the respective short wire cloth units can be easily installed substantially at the same level with respect to a building floor, and so there is no need to form a base in a step-like shape. Furthermore, the initial engagement position between the endless felt 32 and the dewatering instrument 23 can be changed by adjusting the height of a lead-in roll 28 disposed downstream of the couch roll 26 within the felt loop.

As described in detail above, in the multi-layer paper sheet forming system according to the present invention, all the plurality of short wire cloth sections can be installed substantially at the same level, and so, a complicated expensive base having a step-like shape, as in the case with the heretofore known system, is unnecessary. Moreover, a gradually increasing urging pressure of felt is generated by the dewatering instrument having a curved portion, hence it is possible to moderately dewater the stock liquor, and operation at a high grammage and at a high velocity is possible.

In addition, owing to the fact that formation of the respective paper layers is effected by making use of a pulsed pressure generated at the dewatering element portion, the formation is excellent. And this dispersing effect makes an inter-layer bonding strength in a paper sheet strong as assisted by the wet-on-dry combining paper making method. Also, by constructing a dewatering instrument as a vacuum structure, the dewatering capability is increased, a deposition grammage per unit becomes large, hence a number of units can be made small even at a high velocity, and so, the reduction of installation area, as well as the lowering of costs can be achieved.

Furthermore, a degree of vacuum acting upon a dewatering instrument can be made lower than that in the prior art, and hence a reduction of the evacuating airflow rate can be achieved. Also, the invention contributes not only to the reduction of initial costs of an installation, but also to the reduction of running costs thereof. Furthermore, owing to the fact that paper layers are carried loaded on an endless felt, the sheet drop-off phenomenon does not occur, and so a high speed operation can be used. Also, a dispersing effect in the dewatering element portion can be appropriately controlled depending upon a paper making condition, and so flexibility of manufacture is increased.

While a principle of the present invention has been described above in connection to a number of preferred embodiments of the invention, it is intended that all matter contained in the above-description and illustrated in the accompanying drawings shall be interpreted to be illustrative and not as a limitation to the scope of the present invention.

What is claimed is:

1. A multi-layer paper sheet forming system, comprising:

one endless loop of felt, said felt having a traveling direction in said endless loop;

a plurality of short wire cloth sections disposed along said endless loop of felt, wherein each of said plurality of short wire cloth sections comprises an endless short wire cloth and a stationary dewatering instrument comprising an upper surface having a curvature such that said dewatering instrument has a curved portion disposed along said endless short wire cloth such that said endless short wire cloth is between said felt and said curved portion such that said felt can engage stock liquor at an initial engagement point between said felt and said short wire cloth on said curved portion of said dewatering instrument and travel with the stock liquor sandwiched between said short wire cloth and said felt during paper sheet forming so as to form combined paper layers;

a movable return roll disposed along said endless loop of felt so as to engage said felt between respective ones of said plurality of short wire cloth sections such that said felt is movable so that said initial engagement point is movable along said curved portion of said dewatering instrument of one of said plurality of short wire cloth sections, said movable return roll being further disposed above the one of said plurality of short wire cloth sections, wherein said felt at least partially wraps around said short wire cloth of the one of said plurality of short wire cloth sections, and wherein said one endless loop of felt comprises a subsidiary loop of said felt above said dewatering instrument of the one of said plurality of short wire cloth sections; and a shoe blade disposed within said subsidiary loop opposite to said dewatering instrument and biased against said felt toward said dewatering instrument with a variable pressure, said shoe blade comprising a surface having a first portion in contact with said felt and another portion inclined towards said felt so as to define a wedge space between said felt and said inclined portion that converges in the traveling direction of said felt;

wherein said plurality of short wire cloth sections are disposed at substantially the same level relative to the horizontal along said endless loop of felt.

2. The multi-layer paper sheet forming system of claim 1, wherein each said dewatering instrument of said plurality of short wire cloth sections comprises a structure capable of promoting dewatering by means of a vacuum.

3. The multi-layer paper sheet forming system of claim 1, wherein said shoe blade comprises a tube supporting said shoe blade, said tube having a variable internal pressure such that said shoe blade is biased against said felt with variable pressure.

* * * * *